United States Patent [19]

Iwaki

[11] Patent Number: 4,866,619

[45] Date of Patent: Sep. 12, 1989

[54] METHOD OF CONTROLLING FUEL IN AN ENGINE

[75] Inventor: Masato Iwaki, Hiroshima, Japan

[73] Assignee: Mazda Motor Corporation, Hiroshima, Japan

[21] Appl. No.: 886,223

[22] Filed: Jul. 16, 1986

[30] Foreign Application Priority Data

Jul. 16, 1985 [JP] Japan ..... 60-155242

[51] Int. Cl.[4] ..... F02M 51/00

[52] U.S. Cl. ..... 364/431.05; 123/489; 123/480

[58] Field of Search ..... 364/431.05, 431.07; 123/440, 486, 488, 480, 489, 491, 492, 478

[56] References Cited

U.S. PATENT DOCUMENTS

| | | | |
|---|---|---|---|
| 4,441,473 | 4/1984 | Isomura et al. | 123/489 |
| 4,442,815 | 4/1984 | Ninomiya | 364/431.05 |
| 4,467,769 | 8/1984 | Matsumura | 123/489 |
| 4,467,770 | 8/1984 | Arimura et al. | 123/489 |
| 4,535,736 | 8/1985 | Taura et al. | 364/431.05 |
| 4,539,958 | 9/1985 | Ito et al. | 123/488 |
| 4,625,699 | 12/1986 | Kobayashi et al. | 123/489 |
| 4,655,188 | 4/1987 | Tomisawa et al. | 123/489 |

*Primary Examiner*—Parshotam S. Lall
*Assistant Examiner*—V. N. Trans
*Attorney, Agent, or Firm*—Wegner & Bretschneider

[57] ABSTRACT

A quantity of fuel supplied to an engine so as to allow the air-fuel ratio of a gas mixture to be a target air-fuel ratio is subjected to a feedback correction based on an air-fuel ratio sensor. At the time of the feedback correction, a learning correction is also conducted on the basis of a learning value that is calculated in accordance with a feedback correction value. When the learning value to be used for the learning correction is altered, the feedback correction value is initialized. An initialized feedback correction value is an addition of the feedback correction value before the alteration to a deviation of the respective learning values before and after the alteration of the learning values.

18 Claims, 6 Drawing Sheets

METHOD OF CONTROLLING FUEL IN AN ENGINE

BACKGROUND OF THE INVENTION

1. Field of the Invention

The present invention relates to a fuel control apparatus for an engine and, more particularly, to a fuel control apparatus adapted to carry out a control by learning, in addition to a feedback control.

2. Description of the Prior Art

In an engine, particularly an internal combustion engine for vehicles, an air-fuel ratio is frequently controlled according to an output from an air-fuel ratio sensor such as an $O_2$ sensor, that is, a fuel amount supplied to the engine is frequently controlled (or corrected) so that the air-fuel ratio of a mixture gas become a target value.

This feedback control has a problem in the responsiveness of the control. Thus, control by learning or a learning control, in addition to the feedback control, has been recently proposed. In Japanese Patent Application Laid Open No. 59335/1983, the feedback correction is conducted using a feedback correction value that is obtained in accordance with an output from an $O_2$ sensor for detecting the oxygen concentration (air-fuel ratio) in exhaust gas. A learning value is calculated according to the feedback correction value and the learning value is stored in memory means having, for example, a plurality of learning zones divided at every predetermined vehicle speed. At a certain vehicle speed while conducting a sort of prospect control by the learning correction in accordance with the learning value stored in the learning zone of the memory means, corresponding to the vehicle speed, the feedback control as described hereinabove is carried out. Accordingly, an amount of correction by the feedback control (feedback correction value) can be reduced by the amount of the prospect control with the learning value, thus leading to a higher responsiveness of the control.

In particular, according as an increase in the number of learnings as the same driving state is continued for a long period of time, the amount of correction by the feedback correction can be extremely reduced. Also such a learning control may absorb the individual difference of engines, in particular, the individual difference of fuel injection valves, which affects the setting of supplying the fuel amount to a great extent or the individual difference of sensors for detecting the amount of intake air.

However, in the conventional learning control, a problem arises in the control response in instances where a learning value used for the learning correction is altered, leading to a lack in the control accuracy of an air-fuel ratio. More specifically, if the memory means for storing the learning value has a plurality of learning zones divided at every predetermined vehicle speed as described hereinabove, it is common that the learning values stored in two learning zones are different when one learning zone is altered to the other learning zone. Accordingly, if the learning value altered is used immediately after the alteration of the learning zone the control is caused to deviate because the feedback correction value is set on the basis of the learning value before alteration. Accordingly when the learning value to be used for the learning correction is altered, the feedback correction value was heretofore set to a value that is not attributable to any learning value, i.e., initialized to "zero". With such an intialization of the feedback correction value, it requires a considerable amount of time until the air-fuel ratio is stabilized to the target air-fuel ratio after the learning zone is changed.

The delay of the control caused by the alteration of the learning value as described above occurs not only in the case of altering the learning zone but in the case of renewing the learning value, i.e., in the case of updating to the optimum learning value.

SUMMARY OF THE INVENTION

It is therefore an object of the present invention to provide a fuel control apparatus for an engine wherein, in instances where a fuel amount supplied to the engine is subjected to a feedback control according to an air-fuel ratio sensor and and a learning correction is achieved by using a learning value calculated on the basis of the feedback correction value, the control responsiveness is enhanced when the learning value used for the learning correction is altered.

It is another object of the present invention to provide a fuel control apparatus for an engine wherein, in instances where the feedback correction and the learning correction are carried out in the same manner as the above object, the responsiveness of the control is enhanced during a course of the shift of learning zones, where memory means for storing the learning value is divided into a plurality of learning zones in response to the driving states of the engine.

It is a further object of the present invention to provide a fuel control apparatus for an engine wherein, in instances where the feedback correction and the learning correction are carried out in the same manner as the above first object, the responsiveness of the control at the time of updating the learning value is enhanced where the learning value stored in the memory means is updated.

It is still further object of the present invention to provide a fuel control apparatus for an engine wherein, in instances, where the feedback correction and the learning correction are carried out in the same manner as the above first object, the responsiveness of the control is enhanced at the times of both shifting the learning zone and updating the learning value in the identical learning zone, where the learning value stored in the memory is divided into a plurality of learning zones or areas in response to the driving state of the engine and the learning value stored in the learning zone is updated.

It is still another object of the present invention to provide a fuel control apparatus for an engine wherein, in instances where the feedback correction and the learning correction are achieved in the same manner as the first object, the air-fuel ratio can be more precisely controlled.

For achieving the above first object, a first aspect of the present invention provides a fuel control apparatus for an engine which is fundamentally constituted as claimed in claim 1. With such an arrangement, when the learning value to be used for the learning correction is altered, the learning value after the alteration is effectively used as it is to set the feedback correction value immediately after the alteration as the optimum value corresponding to the learning value after the alteration, thereby enhancing the responsiveness of the control.

The above second to fourth objects according to the present invention are achieved by considering the times of both shifting the learning zone and updating the learning value to be the time of altering the learning value as claimed in claim 1.

The above fifth object according to the present invention is achieved by reducing the feedback correction value obtainable on the basis of an air-fuel ratio sensor as the number of alterations, that is, the number of learnings increases, with the prerequisite that the learning value is altered. More particularly, the feedback correction value is calculated as the value based on a deviation between an output signal from an air-fuel ratio sensor and a reference signal corresponding to a target air-fuel ratio. If the deviation is the same as the number of alterations increases, the calculated feedback correction value is decreased. With this arrangement, variations in the air-fuel ratio near the target air-fuel ratio is extremely reduced. In other words, the convergent width converged to the target air-fuel ratio is reduced so that the air-fuel ratio is more precisely controlled.

An air-fuel ratio sensor used in the present invention may include an $O_2$ sensor which operates in ON or OFF at a stoichiometric air-fuel ratio as a boundary if the feedback control is conducted in the stoichiometric air-fuel ratio. If the feedback control is carried out in a wide range of air-fuel ratios, for example, in a stoichiometric air-fuel ratio or in an air-fuel ratio representing a gas mixture leaner than the stoichiometric air-fuel ratio, a so-called lean sensor which may supply a signal substantially proportional to the air-fuel ratio may be used as an air-fuel ratio sensor. As fuel supply means for supplying fuel to the engine may be used a so-called feedback type carburetor, but it is preferable to use a fuel injection value capable of more accurately regulating a quantity of the supply fuel. In this case, the fuel injection amount from the fuel injection valve may be regulated by controlling a pulse width of its drive pulse (e.g., a duty control).

In instances where memory means for storing the learning values is used in which a plurality of learning zones are divided in response to the driving states of the engine, parameters for the driving state of the engine may contain the most fundamental engine load and the engine speed or number of engine revolutions. As the setting or altering of the target air-fuel ratio, a warming-up correction or acceleration correction may be frequently employed, these factors may be included. In addition, suitable factors such as vehicle speed may be employed as parameters in the driving state of the engine.

The learning value is calculated according to a plurality of feedback correction values different from each other at calculating timings. In this case, it is preferable to set a new feedback correction value so as to be given more weight than old feedback correction values. When a learning value is calculated in accordance with a plurality of feedback correction values at different calculating timings, the learning values can be calculated at the stage that the predetermined number of correction values is stored while all feedback correction values sampled are stored. When the number of stored feedback correction values increases, a memory capacity is rendered extremely large. To this end, a temporary learning value according to one feedback correction value is calculated with reference to the calculation formula of a preset learning value and stored, and the stored temporary learning value is corrected (added) in accordance with a feedback correction value sampled thereafter. By making this arrangement, it is enough to store only one temporary learning value even if the number of feedback correction values increases.

The above and other objects, features and advantages of the present invention will be apparent from the description of preferred embodiments which will be hereinafter described in detail with reference to the accompanying drawings.

DETAILED DESCRIPTION OF THE PREFERRED EMBODIMENTS

The present invention will now be described in more detail by way of a preferred embodiment with reference to the accompanying drawings.

Figure 1:
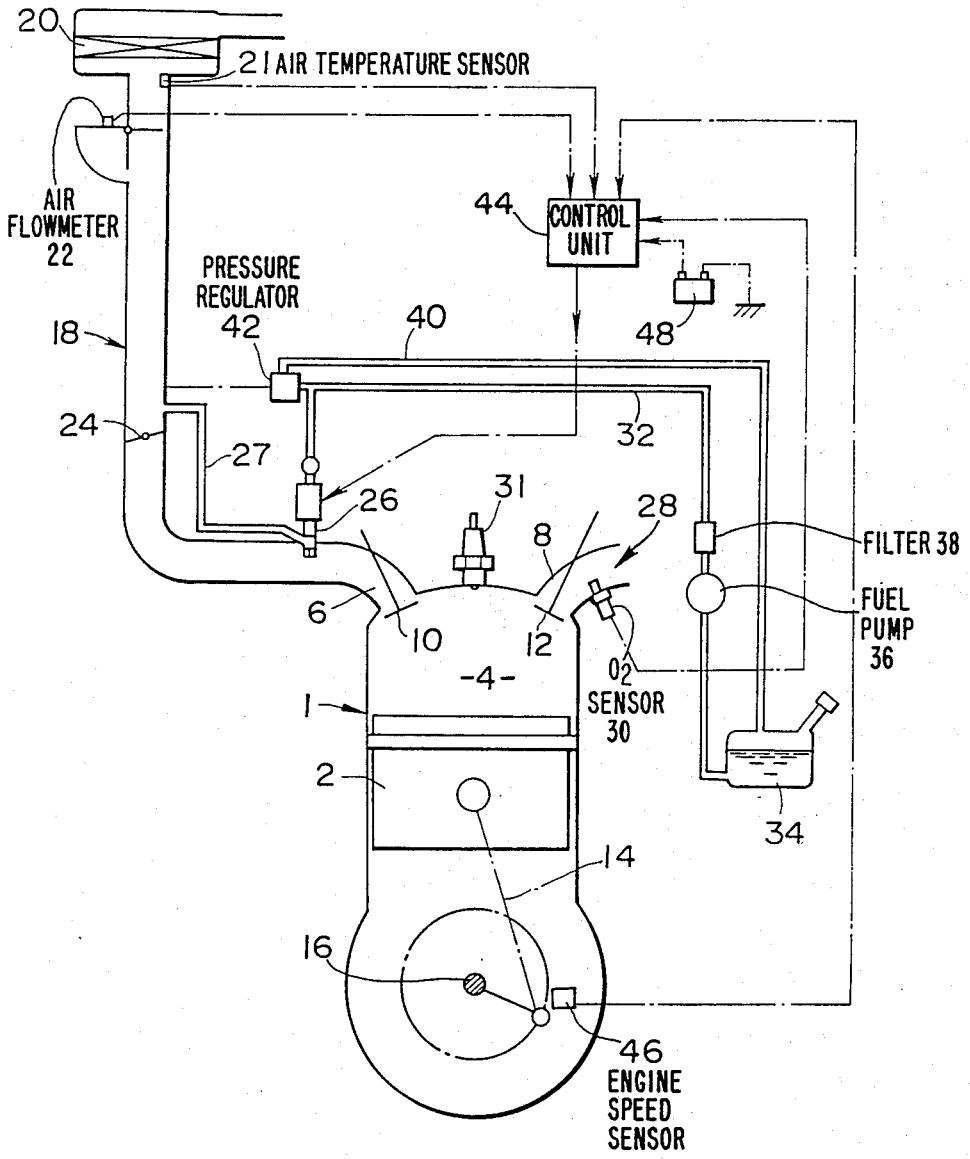
FIG. 1 is an entire system view showing a fuel control apparatus for an engine according to one embodiment of the present invention.
Figure 2:
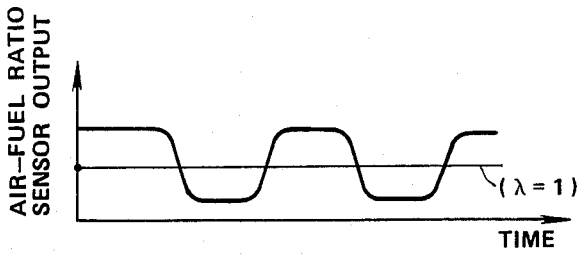
FIG. 2 is a graph showing the state of varying outputs of an air-fuel ratio sensor.

FIG. 1 illustrates one embodiment according to the present invention.

Referring first to FIG. 1, an engine body 1 of 4-cycle reciprocating type is provided with a piston 2 telescoped therein to form a combustion chamber 4. An intake port 6 and an exhaust port 8 are perforated in the combustion chamber 4, an intake valve 10 is disposed in the intake port 6. and an exhaust valve 12 is disposed in the exhaust port 8.

The piston 2 is connected through a connecting rod 14 to an output shaft 16. As the piston 2 reciprocates, the output shaft 16 is rotatably driven, and the intake valve 10 and the exhaust valve 12 are opened and closed at the known timing in synchronization with the rotation of the output shaft 16.

An intake air passage 18 connecting to the intake port 6 is disposed from the upstream side to the downstream sequentially with an air cleaner 20, an intake air temperature sensor 21 for detecting an intake gas temperature, an air flowmeter 22 for measuring a quantity of the intake air, a throttle valve 24 for controlling a quantity of the intake air, and a fuel injection valve 26 for supplying fuel into the intake air passage 18. An exhaust gas passage 28 connecting to the exhaust port 8 is disposed with an $O_2$ sensor 30 as well as a catalyzer and a silencer, omitted in the drawing. An ignition plug 31 is also provided.

Intake air purified by the air cleaner 20 is mixed with fuel injected from the fuel injection valve 26, and the resulting gas mixture is filled in the combustion chamber 4. Combustion gas in the combustion chamber 4 is exhausted through the exhaust gas passage 28. The fuel injected from the fuel injection valve 26 is vaporized and atomized with assist air from an assist air passage 27.

The fuel injection valve 26 is connected to a fuel tank 34 through a fuel supply conduit 32 that in turn is arranged with a fuel pump 36 and a fuel filter 38. When the pump 36 is driven, fuel in the fuel tank 34 is fed under pressure to the fuel injection valve 26, and excessive fuel is returned to the fuel tank 34 through a return conduit 40. A fuel pressure regulator 42 is disposed in the return conduit 40, thereby supplying fuel having a predetermined pressure difference from the internal pressure of the intake air passage 18 to the fuel injection valve 26. The quantity of fuel injection from the fuel injection valve 26 is regulated by controlling the valve open time of the fuel injection valve 26 by means of a pulse width of a drive output signal from a control unit 44 (in a duty control).

The control unit 44 is supplied with a feedback signal from the $O_2$ sensor 30, an intake air temperature signal from the intake air temperature sensor 21, an intake air amount signal from the air flowmeter 22, an engine speed signal from an engine speed sensor 46 and a voltage signal from a battery 48. The control unit 44 controls the air-fuel (A/F), that is, the quantity of fuel injection to be injected from the fuel injection valve 26, on the basis of each of the signals supplied.

The control unit 44 is comprised of a digital or analog computer and more particularly a microcomputer. The control unit 44 comprises conventional parts such as a CPU, an ROM, an RAM, a CLOCK and an input/output interfaces. Further, the control unit 44 is also provided with A/D converters in response to the output signals of the respective sensors and drive circuit for the fuel injection valve 26. Since the above-mentioned arrangement utilizing the microcomputer is heretofore known in general, the detailed description will be omitted.

Figure 5:
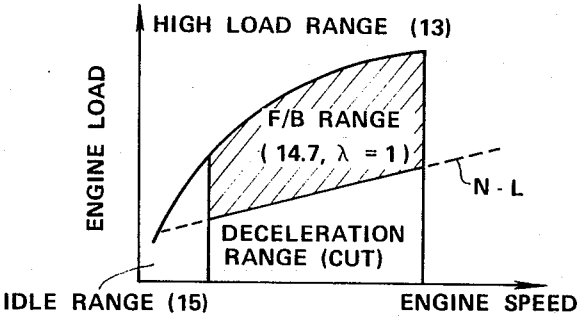
FIG. 5 is a graph showing an example of division of the area for carrying out a feedback control of the air-fuel ratio and the area for carrying out an open loop control in response to the driving state of the engine.

The control by the control unit 44 will be generally described. The operating state of an engine is divided, for example, as shown in FIG. 5, into an idle range, a deceleration range, a feedback range and a high load range in accordance with the engine speed and the load. The control unit 44 controls the air-fuel ratio in response to the respective range of the operating state of the engine. A broken line in FIG. 5 is a no-load line. More specifically, a basic fuel injection amount (a basic fuel injection time $\tau$EI; corresponding to a stoichiometric air-fuel ratio (=14.7) and an oxygen excessive rate $\lambda=1$) is determined in accordance with the intake air amount and the engine speed. A final fuel injection amount (fuel injection time T) is calculated by making various corrections on the basic fuel injection amount, and a drive pulse signal having a pulse width corresponding to this injection amount is supplied to the fuel injection valve 26. The air-fuel ratios in the respective ranges in FIG. 5 is, for example, "14.7" in the feedback range, "15" in the idle range, "13" in the high load range, and the fuel is cut (by half or in full) in the deceleration range. An open loop control (prospect control) is conducted in the ranges other than the feedback range.

Figure 6:
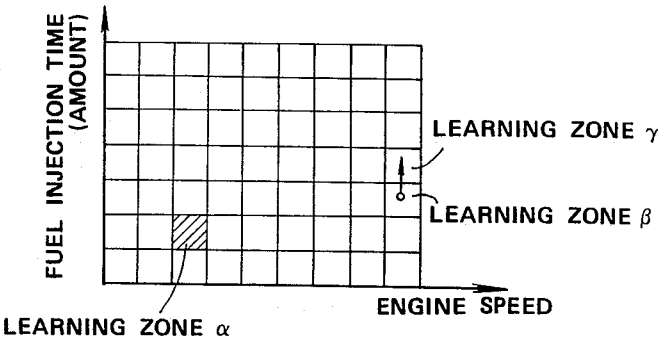
FIG. 6 is a graph showing an example of learning value memory means divided into a plurality of learning zones.

A summary of the control in the feedback range will be described hereinbelow. In the feedback range, a feedback correction according to the feedback signal from the $O_2$ sensor 30 and a learning correction are conducted in the basic fuel injection amount (basic fuel injection time $\tau$EI). In other words, a plurality of learning zones finely divided according to the engine speed and the basic fuel injection time $\tau$EI corresponding to the engine load are set in the feedback range, and the learning values calculated in accordance with the feedback correction value is stored in the respective learning zones of the memory (FIG. 6). The feedback correction value is determined in accordance with a predetermined control gain value (P.I value), and the control gain value (P.I value) and the learning value are altered at every number of learnings.

The fuel injection amount (fuel injection time T) in the feedback range is calculated according to the following equation:

$$T=\tau EI\times C_{AIR}\times(1+C_{FB}+C_{LC})+\tau BAT \quad (1)$$

where $\tau$EI: basic fuel injection time $C_{AIR}$: Intake air temperature correction value $C_{FB}$: Feedback correction value $C_{LC}$: Learning correction value $\tau$BAT: Reactive injection time (Battery voltage correction)

The control gain value (P.I) in the feedback correction value ($C_{FB}$) is altered according to the following equations:

$$C_{FB}=F\ (P.I)$$

$$P=K\times P_0$$

$$I=K\times I_0$$

where $P_0$: skip width initial value $I_0$: Integrating rate initial value

K: Coefficient

Figure 3:
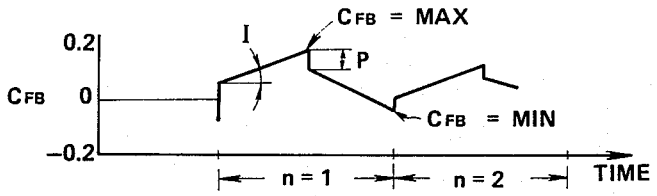
FIG. 3 is a graph showing the state of varying feedback correction values.
Figure 4:
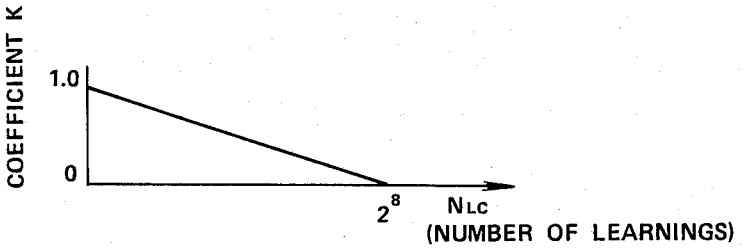
FIG. 4 is a graph showing the relationship between the number of learnings and the feedback correction value in the magnitude of control gain values.

The coefficient K is set smaller, as shown in FIG. 4, as the number of learnings (the number of alterations) $C_{LC}$ increases. From this, the control gain value (P.I value) is set a small value as the number of learnings $C_{LC}$ advances The learning value $C_{LC}$ is altered in every number of learnings according to the following equation from the maximum value $C_{FB}$MAX and the minimum value $C_{FB}$MIN of the feedback correction value $C_{FB}$ sampled at every zone n=1, n=2, . . . (for example, at every zone of 8 msec.) as shown in FIG. 3 at every learning time according to the following equation. In the following equation, "j" means the sequential number of alterations of the learning value, and "i" means the value reduced in the sampling number as the value of "i" is smaller.

$$C_{LCj+1} = C_{Lcj} + \tfrac{1}{4}\cdot\sum_{i=1}^{n}(C_{FB}\mathrm{MAX} + C_{FB}\mathrm{MIN})/2^{n-i+1} \quad (2)$$

When the learning value is altered according to the above, the feedback correction value CFB is also altered or initialized on the basis of the following equation:

$$C_{FBj+1} = C_{FBj} - \frac{1}{4} \cdot \sum_{i=1}^{n} (C_{FB}MAX + C_{FB}MIN)/2^{n-i+1}$$

From the above equation, as the number of learnings $C_{LC}$ advances, the learning value $C_{LC}$ is sequentially optimized, and the responsiveness of the feedback control is gradually improved. When the learning value is altered, for example, in the learning zone $\alpha$ of FIG. 6 the deviation $\Delta x$ of the learning value before and after the alteration is calculated from the equation (2), $$\Delta x = \frac{1}{4} \cdot \sum_{i=1}^{n} (C_{FB}MAX + C_{FB}MIN)/2^{n-i+1}$$

Figure 7:
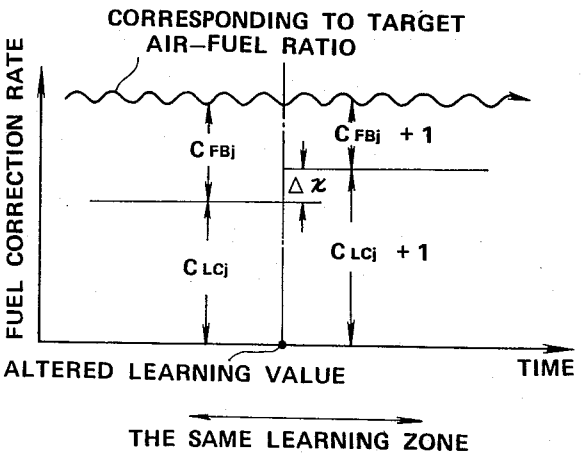
FIG. 7 is a graph showing the relationship between the feedback correction value and the learning value before and after the alteration of the learning values.

The $\Delta x$ is an correction amount of the feedback correction value when the learning value is altered. The relationship between each of the learning values $C_{LCj}$, $C_{LCj+1}$, $C_{FBj}$ and $C_{FB}j+1$ and the $\Delta x$ before and after the learning value is altered as shown in FIG. 7. As readily understood from FIG. 7, the feedback correction value $C_{FBj+1}$ is optimized in response to the alteration of the learning value immediately after the learning value is altered, leading to improvements in the responsiveness of the control, and, as a result, in accuracy in the control of the resultant air-fuel ratio.

When one learning zone is shifted to other learning zone, e.g., when the learning zone $\beta$ is shifted to the learning zone $\gamma$ as in FIG. 6, the initial value $C_{FB0}$ of the feedback correction is initialized according to the following equation:

$$C_{FB0}=C_{FBk+1}+(C_{LCk+1}-C_{LCk+2}) \quad (4)$$

where $C_{FBk+1}$: the feedback correction value immediately before the learning zone is shifted $C_{LCk+1}$: the learning value before the shift (e.g., stored value of the learning zone $\beta$)

$C_{LCk+2}$: the learning value after the shift (e.g., stored value of the learning zone $\gamma$)

The deviation $\Delta y$ of the learning value before and after the shift of the learning zone is as evident from the above equation (4)

$$\Delta y=C_{LCk+1}-C_{LCk+2}$$

Figure 8:
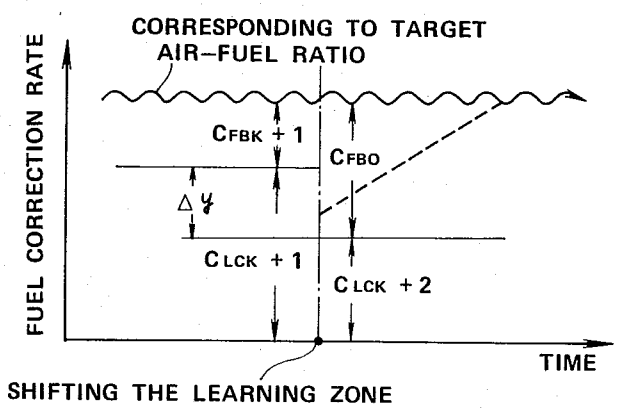
FIG. 8 is a graph showing the relationship between the feedback correction value and the learning value before and after the shift of the learning zones.

The initial value $C_{FB0}$ of the feedback correction value initialized immediately after the learning zone is shifted is a value corrected by the amount $\Delta y$ from the feedback correction value $C_{FBk+1}$ before the shifting (FIG. 8).

Figure 9:
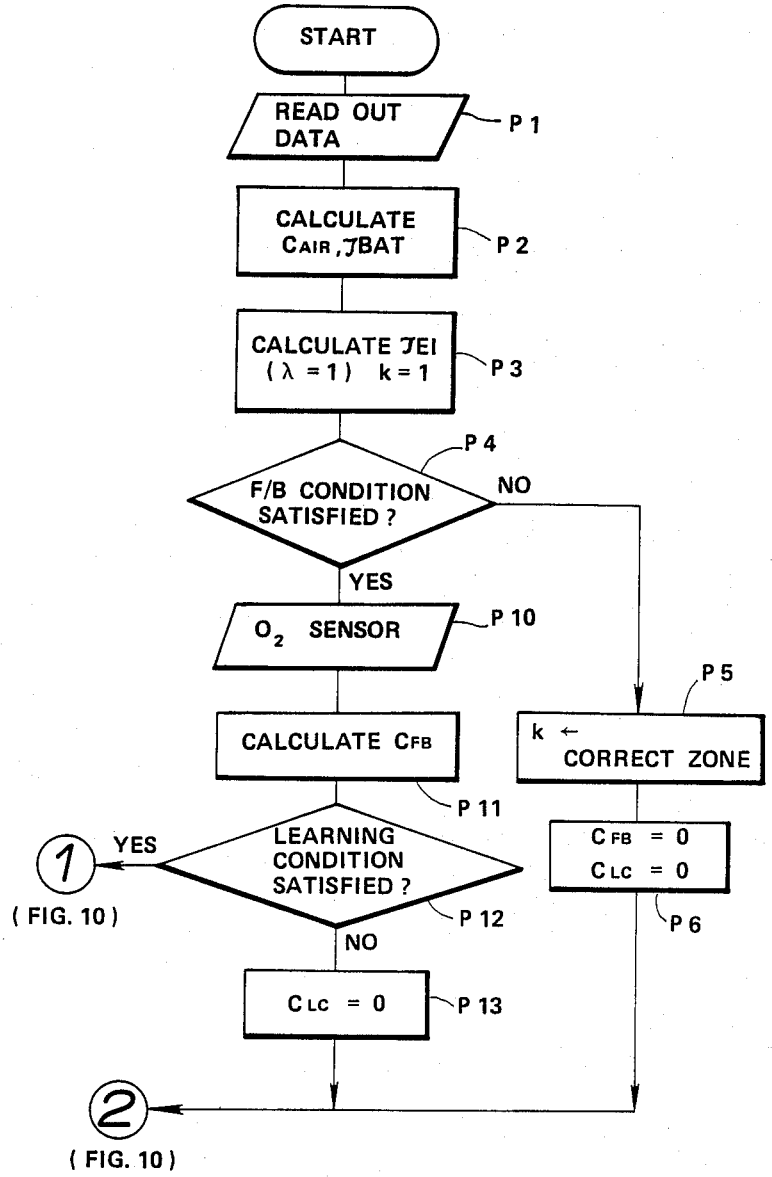
FIG. 9 and FIG. 10 are flowcharts showing an example of a control according to the present invention.
Figure 10:
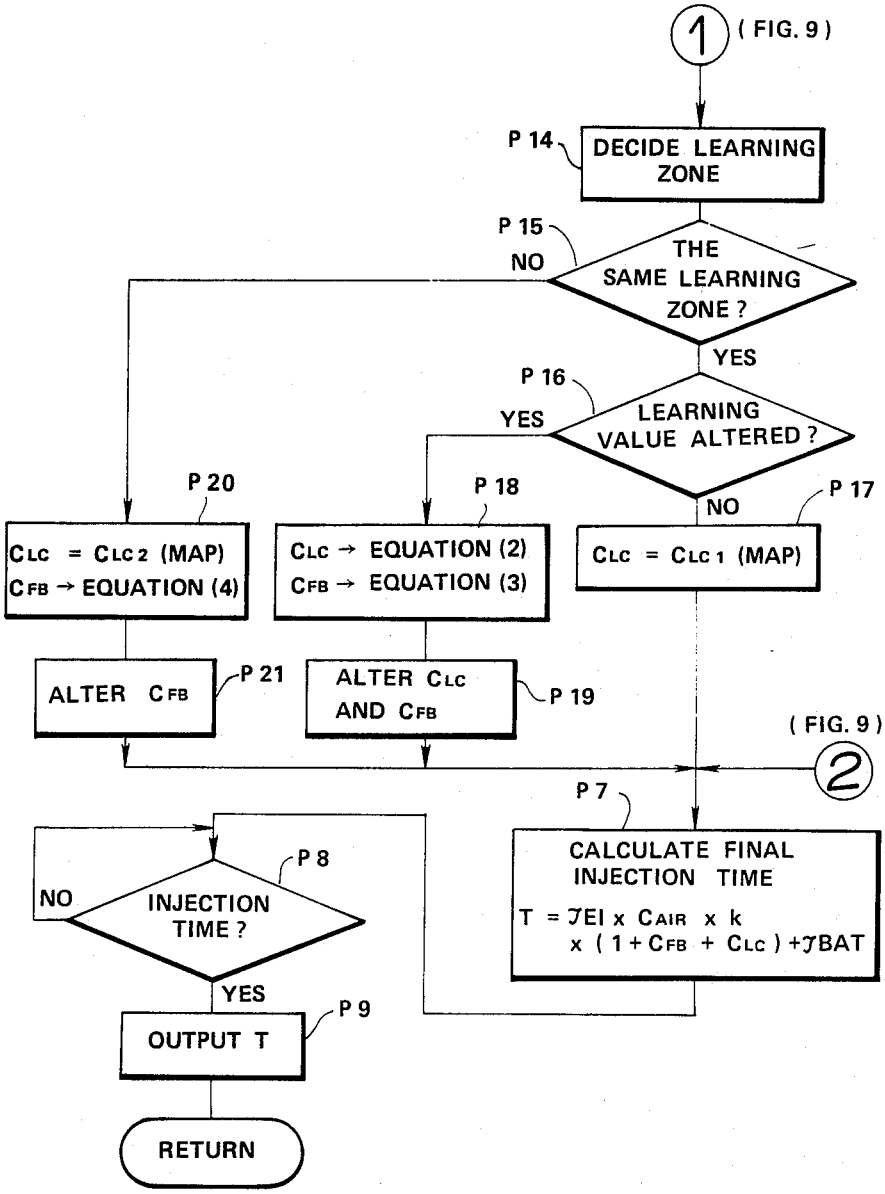

The control by the control unit 44 as described hereinabove will be further described with reference to flowcharts in FIG. 9 and FIG. 10. In FIG. 9, the sampling of the feedback correction value $C_{FB}$ is conducted by means of an interrupt. The countup of the number of learnings $C_{LC}$ is executed in every alteration of the learning value with the prerequisite that the learning value is in the identical learning zone.

In step P1, signals from each of the sensors 21, 22 and 46 except the $O_2$ sensor 30 and the battery voltage are read out. In step P2, the intake air temperature correction coefficient CAIR is calculated in accordance with the intake air temperature, and the voltage correction value (reactive injection time) $\tau$BAT is calculated according to the battery voltage. In step P3, the basic fuel injection amount (time) $\tau$EI is calculated in accordance with the intake air amount and the engine speed. And the zone correction coefficient K is set to 1. The basic fuel injection amount $\tau$EI here corresponds to the stoichiometric air-fuel ratio ($\lambda=1$).

In step P4, it is decided whether the current engine operating state satisfies a feedback condition or not. This decision is fundamentally conducted by referring to the map in FIG. 5. In fact, the conditions that the $o_2$ sensor is active (a predetermined temperature or higher) are additionally considered. If the feedback conditions are not satisfied in the decision of step P4, the control flow is shifted to step P5. In step P5, the zone correction coefficient K is set to become the air-fuel ratio (FIG. 5) corresponding to the current operating state of the engine. Then, the feedback correction value $C_{FB}$ is set to "0" because the feedback correction is not executed at this time, and the learning correction value $C_{LC}$ is set to "0" because the learning correction is not conducted as well.

After step P6, the control flow is shifted to step P7, and the final fuel injection time T is calculated according to the equation indicated in step P7 (where the $C_{FB}$ and the $C_{LC}$ are both "0"). Then, in step P8, when a predetermined fuel injection time is obtained, the final fuel injection time T calculated in step P7 is output in step P9 (fuel injection).

When the feedback conditions are decided to be satisfied in step P4, the control flow is shifted to step P10, and the air-fuel ratio from the $O_2$ sensor 30 is read out. In step P11, the feedback correction value $C_{FB}$ is calculated according to the signal from the $O_2$ sensor 30 as already described above.

After the step P11, it is decided, in step P12, whether the conditions for executing the learning correction is satisfied or not. This decision is made by observing whether a predetermined time, more specifically, 2 seconds, is elapsed or not from the start of the feedback correction when the number of samplings of the feedback correction value $C_{FB}$ that become the bases of calculating the learning value becomes a predetermined value or larger. In step P12, if it is decided that the conditions of the learning correction are not satisfied, the learning correction value $C_{LC}$ is set to "0" in step P13. Then, the processes after step P7 are conducted.

If the conditions of the learning correction is decided to be satisfied in step P12, the control flow is shifted to step P14, and the current learning zone is decided. Then, in step P15, it is decided whether the current learning zone is the same as the previous learning zone or not. If it is decided, in step P15, that the current learning zone is the same as the previous learning zone, it is decided in step P16, whether the learning zone is altered or not. This decision is made by observing whether 2 seconds are elapsed or not from the previous learning alteration. In step P16, when it is decided that the learning value is not altered, the learning correction value $C_{LC}$ is set, in step P17, to the learning value $C_{LC1}$ stored in the corresponding learning zone by referring to the map in FIG. 6. Then, the processes after step P7 are conducted.

If it is decided, in step P16, that the learning value is altered, the control flow is shifted to step P18, and the learning value $C_{LC}$ is calculated according to the previous equation (2). And the feedback correction value $C_{FB}$ is calculated according to the previous equation (3). In step P19, the learning value is altered or updated as the value calculated in step P18, and the feedback correction value $C_{FB}$ is altered or initialized. Thereafter, the processes after step P7 are conducted.

If it is decided in step P15 that the learning zone is not the same as the previous zone, i.e., when the learning zone is shifted, the learning correction value $C_{LC}$ is set, in step P20, according to the learning value $C_{LC2}$ stored in a new learning zone after shifting. In step P20, the feedback correction value $C_{FB}$ is also calculated according to the previous equation (4). Then in step P21, the feedback correction value $C_{FB}$ is altered or initialized to the value calculated in step P20.

While, in the above-described embodiments, a description has been made of the case where the present invention is embodied as described above, it is to be understood that the present invention is not limited to the particular embodiments. Various other changes, modifications and variations may be made within the spirit and scope of the present invention in a range as claimed in claim 1 with reference to the description of the embodiments and the accompanying drawings.

I claim:

1. A method for controlling an air-fuel ratio of a gas mixture supplied to an engine by regulating a basic fuel amount so as to conform said air-fuel ratio to a target air-fuel ratio, comprising:
   - determining the basic fuel amount in response to the operating state of the engine;
   - measuring the air-fuel ratio in exhaust gas of the engine with a sensor;
   - calculating an actual fuel amount which will cause the air-fuel ratio in the exhaust gas to conform to the target air-fuel ratio, comprising:
     - calculating a first feedback correction value in accordance with the air-fuel ratio measured by said sensor, and correcting the basic fuel amount by the feedback correction value,
     - calculating a learning value in accordance with the feedback correction value, and correcting the basic fuel amount by the learning value, and
     - initializing the feedback correction value after calculation of a learning value which is different than a prior learning value, wherein the feedback correction value is initialized to a second value which equals the first feedback correction value plus the difference between the prior learning value and the calculated learning value; and mixing the actual fuel amount with air to form the gas mixture.

2. A method as claimed in claim 1, wherein the mixing step is performed by a fuel injection valve, and further comprising the step of regulating the fuel injection valve so as to mix the actual fuel amount by controlling the pulse width of a drive pulse sent to the fuel injection valve.

3. A method as claimed in claim 1, wherein the operating state of the engine depends at least one engine speed and load on the engine.

4. A method for controlling an air-fuel ratio of a gas mixture supplied to an engine by regulating a basic fuel amount so as to conform said air-fuel ratio to a target air-fuel ratio, comprising:
   - determining the basic fuel amount in response to the operating state of the engine;
   - measuring the air-fuel ratio in exhaust gas of the engine with an air-fuel ratio sensor;
   - sensing operating parameters of the engine;
   - calculating an actual fuel amount which will cause the air-fuel ratio in the exhaust gas to conform to the target air-fuel ratio, comprising:
     - determining an operating state of the engine from the operating parameters,
     - calculating a feedback correction value corresponding to the difference between the target air-fuel ratio and the air-fuel ratio measured by said air-fuel ratio sensor,
     - calculating a learning value according to a plurality of feedback correction values calculated at different calculating times,
     - storing learning values calculated in said learning value calculating step in a learning zone of a learning value memory corresponding to the operating state of the engine,
     - correcting the basic fuel amount by the feedback correction value,
     - correcting the basic fuel amount by the learning value stored in the learning zone corresponding to the operating state of the engine,
     - determining whether the operating state of the engine has changed so as to determined whether to shift from one learning zone to another learning zone, and
     - initializing the feedback correction value to be used in correcting the basic fuel amount when a shift from one learning zone to another is detected, wherein the feedback correction value is initialized to the feedback correction value before the shift plus the difference between the learning value before the shift and the learning value after he shift; and
   - mixing the actual fuel amount with air to form the gas mixture.

5. A method as claimed in claim 4, wherein the mixing step is performed by a fuel injection valve, and further comprising the step of regulating the fuel injection valve so as to mix the actual fuel amount by controlling the pulse width of a drive pulse sent to the fuel injection valve.

6. A method as claimed in claim 4, wherein the operating state of the engine depends at least one engine speed and load on the engine.

7. The method as claimed in claim 4, wherein the step of calculating an actual fuel amount further comprises:
   - altering the learning value stored in a learning zone in accordance with a predetermined condition; and
   - initializing the feedback correction value to be used in correcting the basic fuel amount when the learning value is altered to the feedback correction value before the alteration plus the difference between the learning value before the alteration and the learning value after the alteration.

8. The method as claimed in claim 7, wherein the step of calculating a learning value comprises:
   - sampling the feedback correction value at predetermined time intervals; and
   - calculating the learning value from a plurality of sampled feedback correction values in accordance with a predetermined calculating equation.

9. The method as claimed in claim 8, wherein a maximum feedback correction value and a minimum feedback correction value are sampled within each predetermined time interval.

10. The method as claimed in claim 8, wherein said predetermined calculating equation gives more weight to new sampled feedback correction values than to old sampled feedback correction values.

11. The method as claimed in claim 8, wherein said learning value is altered when a predetermined number of feedback correction values or larger have been sampled.

12. A method for controlling an air-fuel ratio of a gas mixture supplied to an engine by regulating a basic fuel amount so as to conform said air-fuel ratio to a target air-fuel ratio, comprising:

determining the basic fuel amount in response to the operating state of the engine;

measuring the air-fuel ratio in exhaust gas of the engine with an air-fuel ratio sensor;

calculating an actual fuel amount which will cause the air-fuel ratio in the exhaust gas to conform to the target air-fuel ratio, comprising:

calculating a feedback correction value corresponding to the difference between the target air-fuel ratio and the air-fuel ratio measured by said air-fuel ratio sensor, calculating a learning value according to a plurality of feedback correction values calculated at different calculating times, storing the learning value thus calculated, altering the learning value thus stored in accordance with a predetermined condition, correcting the basic fuel amount by the feedback correction value, correcting the basic fuel amount by the stored learning value, and initializing the feedback correction value to be used in correcting the basic fuel amount when the learning value is altered, wherein said feedback correction value is initialized to the feedback correction value before the alteration plus the difference between the learning value before the alteration and the leaning value after the alteration; and mixing the actual fuel amount with air to form the gas mixture.

13. A method as claimed in claim 12, wherein the mixing step is performed by a fuel injection valve, and further comprising the step of regulating the fuel injection valve so as to mix the actual fuel amount by controlling the pulse width of a drive pulse sent to the fuel injection valve.

14. A method as claimed in claim 12, wherein the operating state of the engine depends at least on engine speed and load on the engine.

15. The method as claimed in claim 12, wherein the step of calculating a learning value comprises:

sampling the feedback correction value at predetermined time intervals; and calculating the learning value from a plurality of sampled feedback correction values in accordance with a predetermined calculating equation.

16. The method as claimed in claim 15, wherein a maximum feedback correction value and a minimum feedback correction value are sampled within each predetermined time interval.

17. The method as claimed in claim 15, wherein said predetermined calculating equation gives more weight to new sampled feedback correction values than to old sampled feedback correction values.

18. The method as claimed in claim 15, wherein said learning value is altered when a predetermined number of feedback correction values or larger have been sampled.

* * * * *